US006732494B1

(12) United States Patent
Nolte

(10) Patent No.: US 6,732,494 B1
(45) Date of Patent: May 11, 2004

(54) ENVELOPE WITH AN ADHESIVE CLOSURE AND METHOD AND DEVICE FOR PRODUCING THE SAME

(75) Inventor: Bert Nolte, Notzingen (DE)

(73) Assignee: Otto Ficker AG (DE)

( * ) Notice: Subject to any disclaimer, the term of this patent is extended or adjusted under 35 U.S.C. 154(b) by 0 days.

(21) Appl. No.: 09/889,712

(22) PCT Filed: Jan. 18, 2000

(86) PCT No.: PCT/EP00/00330

§ 371 (c)(1),
(2), (4) Date: Sep. 21, 2001

(87) PCT Pub. No.: WO00/43280

PCT Pub. Date: Jul. 27, 2000

(30) Foreign Application Priority Data

Jan. 19, 1999 (DE) ..... 199 01 821

(51) Int. Cl.[7] ..... B31B 1/26
(52) U.S. Cl. ..... 53/459; 493/186; 493/216
(58) Field of Search ..... 493/186, 216; 229/80; 53/455

(56) References Cited

U.S. PATENT DOCUMENTS

| | | | | |
|---|---|---|---|---|
| 1,836,911 A | | 12/1931 | Fitch | |
| 1,944,020 A | | 1/1934 | Vogel | |
| 2,384,223 A | * | 9/1945 | Wilbur | 24/17 |
| 2,549,110 A | | 4/1951 | Michael | |
| D275,036 S | | 8/1984 | Lloyd-Jones | D25/79 |
| 4,715,531 A | * | 12/1987 | Stewart et al. | 229/73 |
| 4,838,004 A | | 6/1989 | Adell | 52/718.1 |
| D306,078 S | | 2/1990 | Whitney | D25/119 |
| 5,065,960 A | | 11/1991 | Castellucci | 244/131 |
| 5,106,037 A | | 4/1992 | Sherrill | 244/132 |
| 5,429,576 A | * | 7/1995 | Doderer-Winkler | 493/214 |
| 5,568,210 A | * | 10/1996 | Kiehne et al. | 353/120 |
| 5,603,472 A | | 2/1997 | Hutter, III | 244/132 |
| 5,687,903 A | * | 11/1997 | Akridge et al. | 229/75 |
| 5,695,154 A | | 12/1997 | Castellucci et al. | 244/130 |
| 5,776,285 A | | 7/1998 | Blumle | |
| 5,960,607 A | * | 10/1999 | Bohn et al. | 53/53 |
| 6,070,792 A | * | 6/2000 | Foushee | 229/302 |
| 6,290,120 B1 | * | 9/2001 | Guest | 229/80 |
| 6,545,086 B1 | * | 4/2003 | Kosal | 524/806 |

FOREIGN PATENT DOCUMENTS

| | | |
|---|---|---|
| DE | 614 353 | 5/1935 |
| DE | 11 83 774 | 12/1964 |
| DE | 22 18 085 | 10/1973 |
| DE | 35 43 136 | 6/1987 |
| DE | 694 03 311 | 6/1995 |
| FR | 2 749 828 | 12/1997 |
| GB | 836003 | 6/1960 |
| GB | 1 570 782 | 7/1980 |
| WO | 90/11943 | 10/1990 |

* cited by examiner

*Primary Examiner*—Rinaldi I. Rada
*Assistant Examiner*—Gloria Weeks
(74) *Attorney, Agent, or Firm*—Akerman Senterfitt

(57) ABSTRACT

An envelope consisting of a front side and a rear side which are interconnected by side flaps, has a fold-back flap to which a layer of contact adhesive is applied. The adhesive used is a strong contact adhesive which is effective without moistening or activation by any other means. The fold-back flap is laid against the rear side of the envelope for the purposes of transport and storage, an area coated with a parting agent being provided so that the adhesive can be detached before use. The envelope is closed by pressing the otherwise uncoated closing flap onto the adhesive-coated fold-back flap. The adhesive is applied to the fold-back flap by transfer, i.e. the adhesive is applied to the parting agent layer during production and then transferred to the fold-back flap when the latter is redressed.

15 Claims, 4 Drawing Sheets

ENVELOPE WITH AN ADHESIVE CLOSURE AND METHOD AND DEVICE FOR PRODUCING THE SAME

FIELD OF APPLICATION AND PRIOR ART

Envelopes normally have a front side carrying the address or an address window, to which is connected at one side a closing flap, and on the other side a bottom flap or rear side, which is bonded to the side flaps, around which is folded the front side.

Several systems exist for closing or sealing an envelope following the filling thereof.

A gumming of the closing flap makes possible to close the same after moistening. However, this closure is unreliable, because the holding force is dependent on the degree of moistening and the adhesive also requires a certain time for hardening, so that if the envelope is excessively filled the flap easily springs open again before the glue has set.

There are also self-adhesive envelopes with a latex adhesive, which is applied both to a fold-back flap located on the rear side and to the closing flap. Normally this adhesive does not adhere to other surfaces, but only to the adhesive coating corresponding thereto, so that closure takes place by pressing together the two like latex adhesive coatings. However, this cohesive adhesive suffers from the disadvantage that it does not provide a very reliable closure and can optionally be opened in non-destructive manner. It more particularly has an ageing tendency, so that such so-called self-adhesive envelopes, particularly under the influence of heat, completely lose their closing force after a short time.

In addition, contact adhesive envelopes are conventionally used, in which a relatively aggressively adhering contact adhesive is applied to the closing flap. Its adhesive force is very great, the closure is reliable and closing can easily take place. However, it suffers from the disadvantage that prior to use the contact adhesive must be covered by a separate, siliconized cover strip, which must be pulled off for use purposes. It must then be disposed of, which is disadvantageous. It is known from DE 43 14 685 A to apply the contact adhesive to the cover strip and then stick the latter to the closing flap.

WO 90/11 943 discloses an envelope with an adhesive closure, where a contact adhesive is applied to the fold-back flap. Part of the envelope back associated therewith is coated with a parting agent. Thus, in the unused state the fold-back flap is flapped against the parting agent coating. After filling the envelope the fold-back flap is unfolded and can now be bonded to the closing flap. The disadvantage arises that the contact adhesive coating can only cover part of the fold-back flap, because otherwise it would not be possible to mechanically fold the latter and this impairs the reliability of closure.

PROBLEM AND SOLUTION

The problem of the invention is to provide an envelope, which also includes dispatch bags, packs, etc., as well as a method and device for producing the same, which for closure purposes permit the use of a very effective, ageing-resistant adhesive without residual products (e.g. cover strips) and without any disadvantages concerning the shape and serviceability of the envelope.

This problem is solved by the envelope according to claim 1.

Through the application of the contact adhesive to the parting coating and the folding over the same of the envelope part on which the contact adhesive is to be finally provided, the contact adhesive on folding said area again is transferred to the envelope part not coated with a parting agent and is ready for use. The adhesion of the adhesive coating to the part not coated with the parting agent (fold-back flap) is much greater than on the parting agent coating. This avoids any application of contact adhesive to an area which, following its application, must be folded round. This facilitates manufacture, because e.g. a folding roller need only have a corresponding recess at the point facing the area coated with contact adhesive, whereas the up to then uncoated fold-back flap can be gripped at a random point and folded round. It is also possible to substantially completely provide the fold-back flap with contact adhesive and in particular up to the lateral edges in order to increase the reliability of closure. This is aided by the fact that the contact adhesive normally requires no drying. Up to now envelopes required holding-down devices on a drying section and gaps had to be left in the gluing for the same.

In an embodiment of the invention contact adhesive is only provided for the fold-back flap. The back of the envelope has a parting coating in the area on which the fold-back flap rests in the flapped back state. Thus, the adhesive surface of the contact adhesive is covered by the envelope back with the parting area provided thereon. This is not prejudicial either during transportation or during filling. After flapping up the fold-back flap it is free and can be bonded to the closing flap free from adhesive.

In another embodiment the contact adhesive can be provided on the closing flap and the parting coating covering the same in the unused state on the inside of the envelope, namely in an area which is exposed by the folded round fold-back flap. After folding up the fold-back flap it is bonded with the contact adhesive to the closing flap.

The contact adhesives used can be of a conventional nature, e.g. synthetic resin dispersions having a water base and with adhesive characteristics with respect to the envelope material used. Use can also be made of hotmelts, which are applied at processing temperatures of e.g. 120 to 200° C., but which have a permanent adhesive action even at ambient temperature. A strong adhesive action is evolved without requiring moistening or any other activation prior to bonding. One water-based product which can be used is commercially available under the trade name "Eukalin 5354 Ha", and a hotmelt with the trade name "Swift H 686/4". The parting agent coating, which is either applied as a separate coating or which can already be present on the material used, can e.g. contain an acrylate resin, silicone acrylate or some other silicone compound. The dehesive property is important. Use can be made of any release varnishes or lacquers, whose properties are based on the fact of closing the pores and therefore providing no touching possibility for the contact adhesive.

As the contact adhesive requires no drying prior to the further processing of the envelope, during the manufacture of the latter there is no need for a drying section taking up a large part of the manufacturing machine. In order to permit the application of the normal moisture-activatable gumming and so as to keep the drying section short, it was hitherto necessary to have a very significant staggering or overlapping of the envelopes in the machine. This can now be reduced or can be completely obviated in certain circumstances.

If the contact adhesive is applied to the parting agent coating, this occurs before the fold-back flap is folded back. For folding back a folding station is needed, which is constructed in such a way that the envelope does not get caught on the corresponding folding tools as a result of its contact adhesive coating. As a result of a corresponding recess on a folding roller provided in the folding station and/or a parting agent coating at this point this feature can be fulfilled.

These and further features can be gathered from the claims, description and drawings and the individual features, both singly or in the form of subcombinations, can be implemented in an embodiment of the invention and in other fields and can represent advantageous, independently protectable constructions for which protection is claimed here.

The subdivision of the application into individual sections and the subheadings in no way limit the general validity of the statements made thereunder.

BRIEF DESCRIPTION OF THE DRAWINGS

An embodiment of the description is described in greater detail hereinafter relative to the drawings, wherein show.

DESCRIPTION OF PREFERRED EMBODIMENTS

Figure 1:
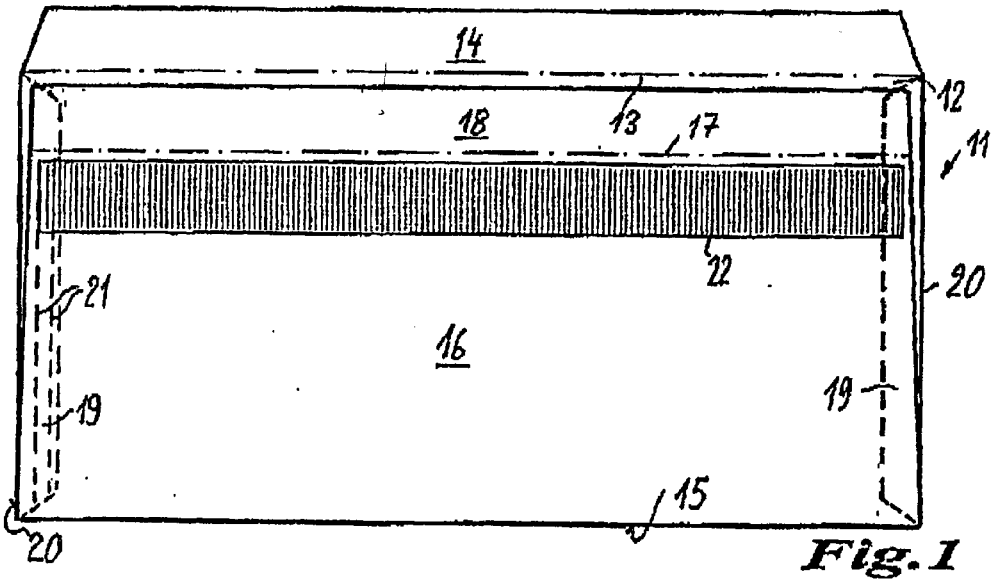
FIGS. 1 to 5 An envelope from the rear, in different phases of production or use.

FIGS. 1 to 5 show an envelope, which is made from a web of flat material, preferably paper, by folding and bonding or applying adhesive coatings. It is also possible to effect production from individual sheets and the materials used can widely vary. The envelope 11 shown is in the standard format. However, it is fundamentally possible to produce dispatch bags and packs with and without bottom or side folds in the manner which will be described.

The envelope 11 has a front side 12, which faces the observer and which is provided for addressing purposes and optionally has a viewing window, to which is connected by means of a scored fold line 13 a closing flap 14. On the opposite side a bottom fold 15 connects an envelope back 16, which is folded with its inner face against the inner face of the front side and extends to just in front of the fold line 13 and with respect to which is demarcated by a fold line 17 a fold-back flap 18, which runs parallel to the closing flap 14 and which is dimensioned in such a way that the closing flap 14 covers it in the closed state of the envelope (FIG. 5), but in the unused state (transportation and storage state according to FIG. 3) runs parallel alongside the same.

Side folds 20 shape side flaps 19 onto the envelope front 12 and are bonded with the lateral edges of the envelope back 16 by two parallel glue joints or seams 21. The bonding extends from the vicinity of the bottom fold to the fold line 17 of the fold-back flap 18. The area of the back adjacent to the fold line 17 is provided with a surface having separating or parting characteristics with respect to a contact adhesive. This area is also referred to as the parting agent area 22 hereinafter and is positioned in such a way that it is as large or larger as a contact adhesive area 23 on the fold-back flap. The contact adhesive area extends virtually over the entire width of the fold-back flap and the envelope. The parting agent area 22 need only be as wide as the contact adhesive area and has to be positioned in such a way that on folding the fold-back flap 18 round the fold line 17 the contact adhesive is solely located on the parting agent area (FIG. 3).

Figure 2:
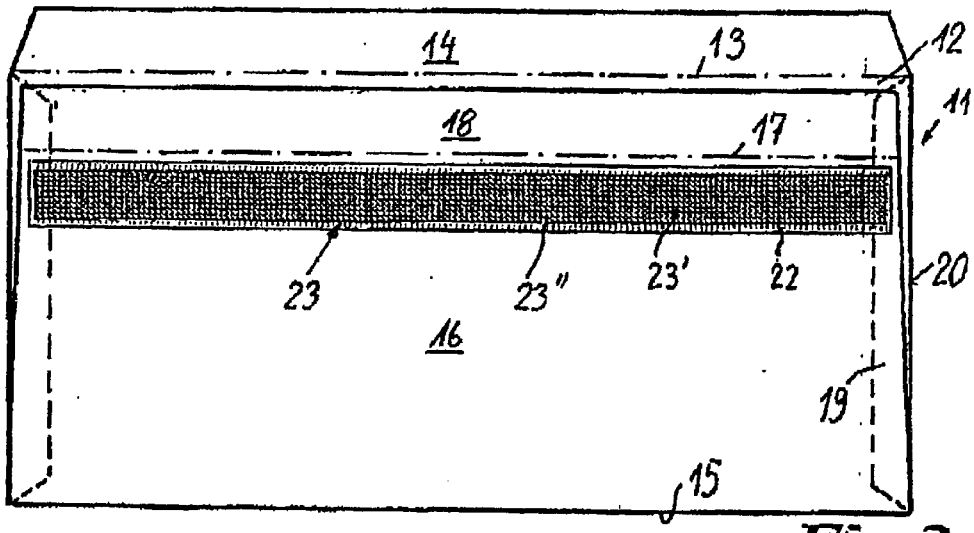

Whereas FIG. 1 shows the envelope prior to the application of the contact adhesive, FIG. 2 shows the envelope shortly prior to completion, i.e. prior to the folding round of the closing flap 14 and fold-back flap 18. FIG. 3 shows the finished envelope in the manner it leaves the production machine and is packed and dispatched. The closing flap 14, which is completely free from adhesive, is folded against an area of the inner surface of the front side, whereas the fold-back flap 18 folded against the rear side 16 covers the contact adhesive area 23 located on the parting agent area 22.

Figure 3:
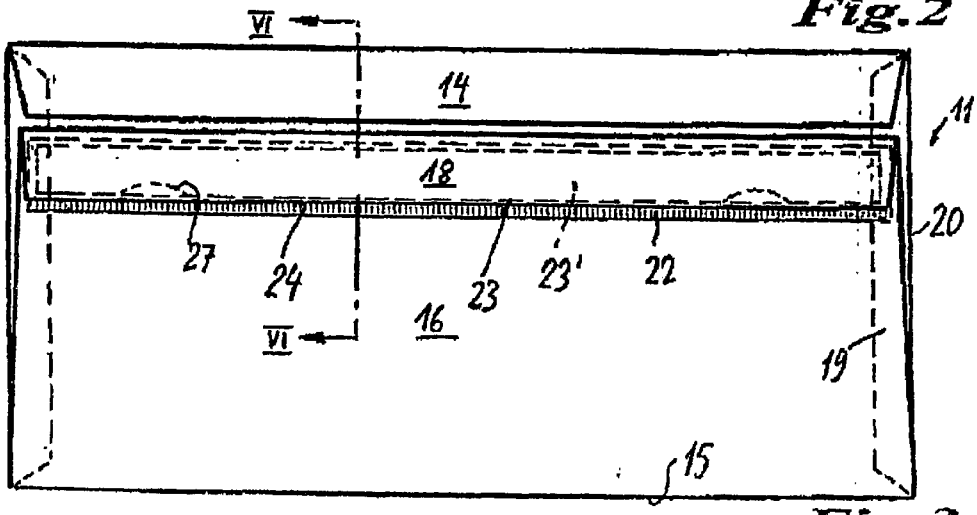

Before using the envelope, i.e. before filling it, the closing flap 14 is flapped up, whereas the fold-back flap 18 remains in its position according to FIG. 3. This forms a very large, readily accessible filling opening. After filling the fold-back flap is folded up, so that the envelope assumes the position according to FIG. 4.

Figure 4:
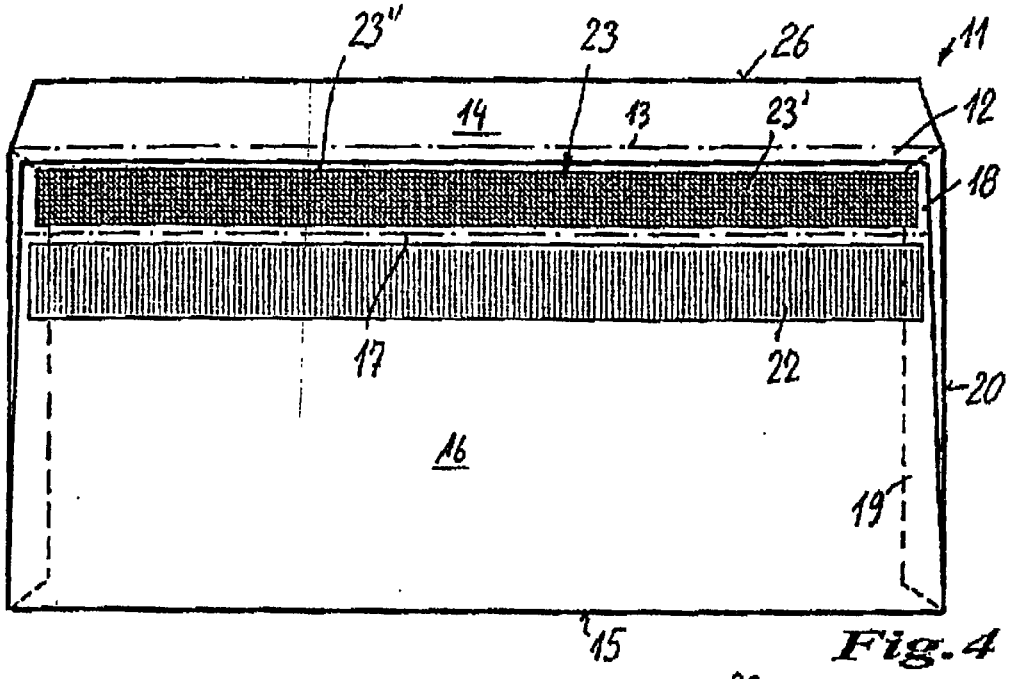

As a result of the different adhesive and dehesive conditions, the contact adhesive coating 23 is detached from the parting agent area 22. Thus, the contact adhesive is transferred to the fold-back flap (FIG. 4). This can be assisted by the recesses 27 of the contact adhesive area 23 visible in FIG. 3 and which form gripping recesses for raising the fold-back flap 18.

Figure 5:
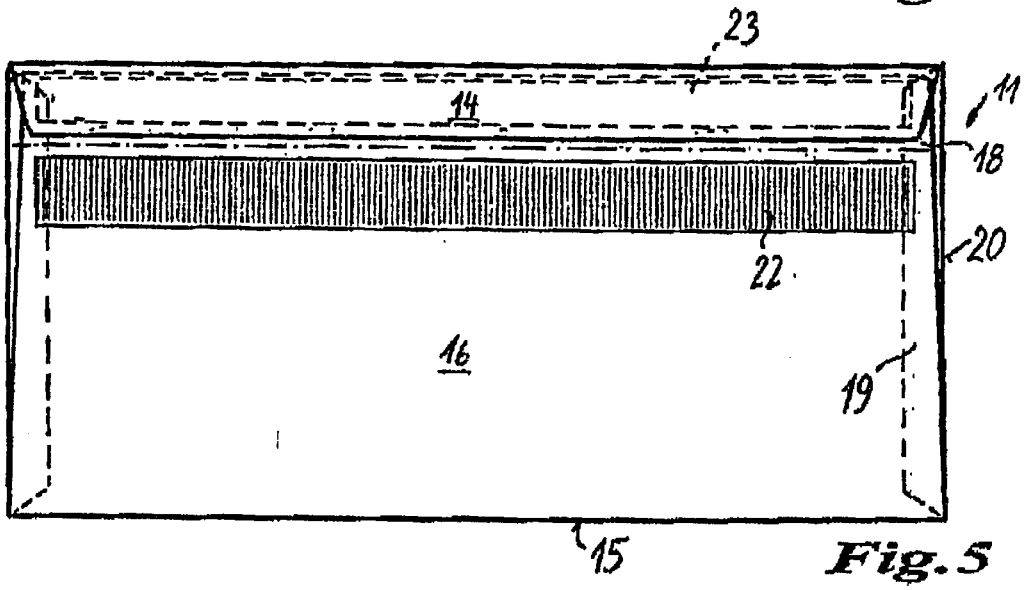

After closure, by folding down the closing flap 14 onto the contact adhesive area, which is located on the now folded fold-back flap 18, the envelope is closed (FIG. 5).

Thus, the envelope is closed by an adhesive, reliable and not usually non-destructively openable adhesive closure, without the contact adhesive area having to be freed beforehand from a separate cover strip. The parting agent coating, which can also be called an anti-adhesion coating, can be applied in the form of a varnish or lacquer or some other coating form in single or multiple layer form and is not prejudicial to use or appearance, because it can e.g. be transparent. A particular advantage is that the opened closing flap along which the filling material slides, is completely free from adhesive. It would also be possible to link the parting agent coating with a printing of the envelope. It is also conceivable to make the envelope from a material, whose outer face is formed from a material dehesive with respect to the contact adhesive used and through special measures it is possible to bring about adhesion between the contact adhesive coating 23 and the corresponding area of the fold-back flap. The inside of the envelope could have a surface without parting characteristics or the latter could be separately produced in the closing flap area.

If, in a variant, the contact adhesive is provided on the inside of the closing flap and the parting agent covers the facing area of the inside, although the outside of the envelope is kept free from parting agent, the closing flap can only be folded outwards after filling the envelope, which is less advantageous as regards use.

Figure 7:
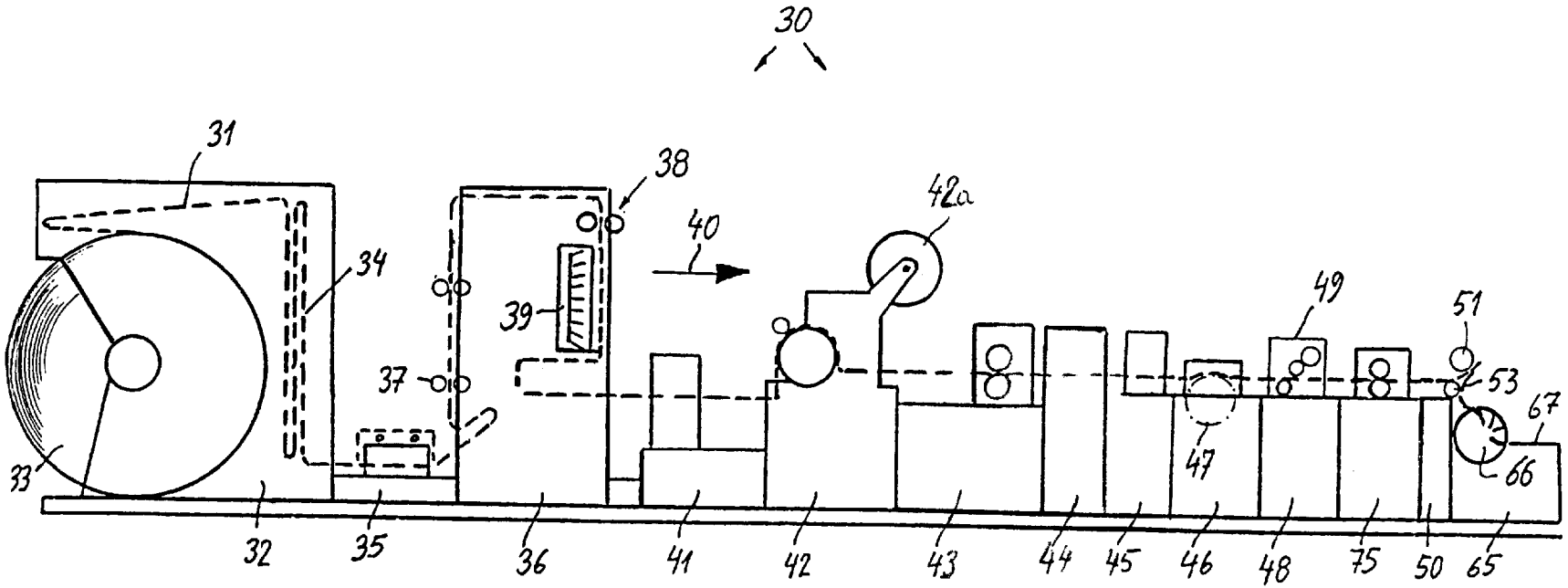
FIG. 7 A diagrammatic representation of a machine for producing the envelope in side view.

The device 30 for producing the envelopes 11 from a paper web 31 shown in FIG. 7 is built up from stations lined up in the manner of a modular system in the following way:

In an unwinding station 32 is located a supply roll 33 for the paper web 31. The web 31 is drawn off the same and guided over a compensating section 34, which inter alia ensures a uniform web tension. It is also possible to have a roll change without stopping the machine. It then passes via a web regulating station 35, which carries out a transverse orientation of the web, into a printing station 36, in which are provided the printing units 37, usually in the form of flexographic printing units, for the purpose of printing the paper web, e.g. for the inside of the envelope. Said printing station also contains an application or printing unit 38 for applying the parting agent area 22.

By means of the application unit 38 the parting agent, e.g. a release lacquer is applied and at a corresponding point, e.g. visible in FIGS. 1 to 3, forms a dehesive surface, where e.g. the paper pores are closed and the fibres covered. In the device 30 this takes place on the undivided web, which has not yet been cut to size in accordance with the shape of the subsequent envelope.

The parting agent coating is then dried by a drying device 39, e.g. with infrared or ultraviolet radiation means. This is followed in the web running direction 40 by a window cutting out station 41 with which optionally cutting out takes place of the recess for an address window. In the following window material station 42 a roll 42*a* supplies transparent window material and is bonded or sealed over the window recess. In the following shape cutting station 43, with a still cohesive web, the two sides of the web are cut in such a way that the marginal contour representing the side flaps 19, etc. is obtained. Simultaneously or in other stations there is a scoring of the different fold lines 13, 15, 17 and 20.

In the side flap folding and gumming station 44, which follows as close as possible to the shape cutting station, the side flaps 19 are folded inwards and provided with two parallel adhesive strips 21. Particularly in the area adjacent to the fold line 17 the glue strips 21 can also be joined together so as to interconnect in a particularly effective manner said area. Finally the material web is transversely cut in the separating cutting station 45, i.e. the fold-back flap edge 24 is separated from the closing flap edge 26. Subsequently the rear side or bottom flap 16 is folded round the fold line 15 and by means of the two parallel glue seams 21 is bonded on either side with the side flaps 19, but the area of the fold-back flap 18 remains free.

This is followed by an overlapping or staggering of the envelopes in the staggering or overlapping station 46. The latter can have a staggering wheel 47, which has a roller-like construction, and on its surface successive steps or stops pointing in the opposite direction to the conveying direction and which are provided with the desired overlap or stagger spacing. This roller can have a sawtooth profile, similar to a wheel or gear in a locking pawl. The staggering wheel 47 leads to a staggered or overlapping flow of envelopes 11 in that the incoming envelopes pass with their leading fold edge 15 through the arrangement of said staggering wheel and as a result of the lower circumferential speed of said wheel compared with the incoming envelopes and run up under the leading, already more slowly conveyed envelopes and against the step-like stops with the desired overlap spacing matched to the circumferential speed. This leads to an overlapping flow of envelopes 11, which are conveyed on by a conveying means, e.g. a belt conveyor. This serves to reduce the very high conveying speed of the single envelope flow of up to 600 m/min as a result of an overlapping of the envelopes. This was necessary in the conventional devices due to the necessary drying of the moisture-activatable glue applied prior to staggering (gumming) or latex gluing, because the drying section would otherwise become too long and the high conveying speed would have given rise to problems with the individual envelopes. Moreover, with such a gumming, glue application would have been effected continuously, i.e. only the area of each envelope to be gummed would be left free by the staggering operation.

According to the invention in the following contact adhesive application station is provided an adhesive application device 49 operating with a rotating roller similar to a printing unit and with which the contact adhesive is applied to the parting agent area 22 (cf. FIG. 2). The adhesive action on the parting coating should at least be sufficient to ensure that the contact adhesive adheres thereto during processing in the machine. The contact adhesive area can be so large that it takes up almost the entire fold-back flap 18. This station preferably operates with an application roller having one or more individual, mutually circumferentially spaced application segments. They can be equipped for a uniform adhesive application with a rastered surface, i.e. provided with closely juxtaposed depressions, which is doctored following the adhesive supply, e.g. by immersion or transfer from an adhesive-carrying roller. This leads to a particularly uniform and laterally precisely defined contact adhesive surface.

As no subsequent drying is necessary for the contact adhesive prior to further processing, there is no need for the usually subsequently provided drying section. The staggering of the envelopes in the staggering station consequently need not be as close as is required there due to the gluing and drying and is instead only dependent on the speed with which the application roller of the contact adhesive application station 48 can rotate. In all cases the area to be coated must remain free. Due to the omission of the drying section it is not absolutely necessary, as in the known machines, to subsequently provided a special regulating or orienting station, so as to reorient on the drying section any envelopes displaced from the precise sequence. Through the omission of the drying section there is also no need for holding-down devices in the form of belts and for which gaps must be left in the gluing. This limited the complete gluing over virtually the entire width of the envelopes made possible by the invention.

In a following extraction station 75, which simultaneously supplies the following fold-back flap folding station 50, the envelopes 11 are separated again.

Figure 8:
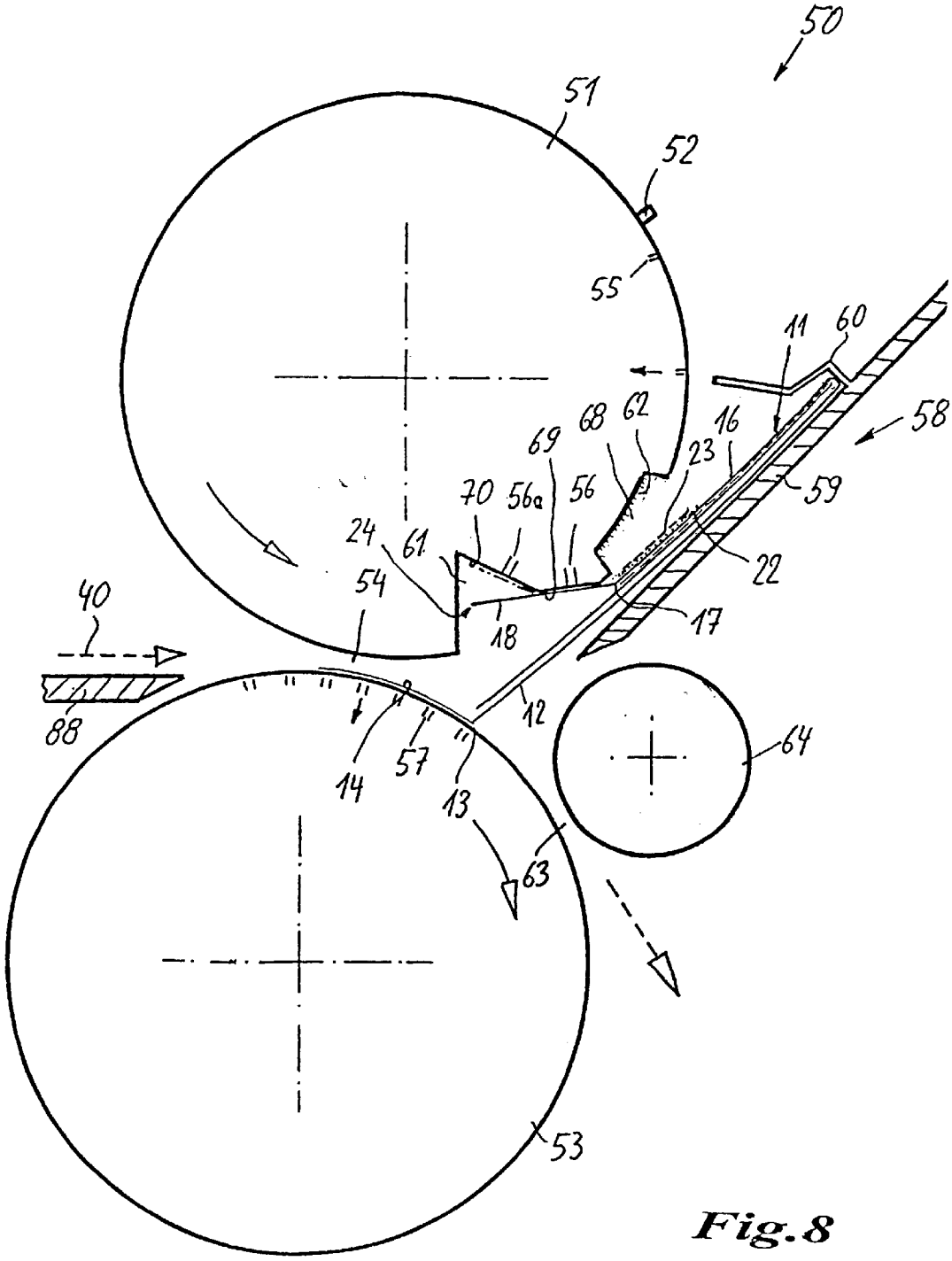
FIG. 8 A detail of a folding station for the closing and fold-back flap in a diagrammatic representation, for an envelope according to FIGS. 1 to 3.

The separated envelopes 11 then run into the fold-back flap folding station 50, which operates in accordance with the diagram shown in FIG. 8. The leading bottom fold edge 15 of the envelope 11 runs against a stop 52 provided on its upper fold roller 51 and which fulfils any necessary orienting or aligning function. The upper fold roller 51 and the fold roller 53, set back somewhat in the conveying direction, located below the same and in parallel and rotating in the opposite direction, form between them a gap 54 through which pass the envelopes. The fold rollers are provided with suction slits or openings 55, 56, 57 selectively controllable as a function of their circumferential position. Said slits or openings are connected by not shown, conventional control means in the manner of rotary slide valves to a corresponding suction air source. The envelopes arriving on a conveyor or assembly line 88, simultaneously with the running up against the stop 52, are sucked by the suction openings 55 onto the fold roller 51 and entrained in the rotation direction thereof corresponding to the start of the conveying direction 40. The suction openings selectively free the envelope in good time in the rotation direction, so that it can be collected by a collecting pocket 58, which comprises an upwardly sloping collecting plate 59 and a stop 60 forming the pocket bottom. The envelope is stopped in the vicinity of the stop 60 without striking hard against the latter, because the suction action is activated on the lower fold roller 53 also rotating in the vicinity of the gap 54 in the conveying direction and the suction slits 57 there engage the closing flap 14 and entrain it with the rotation of the fold roller.

In good time a row of narrow suction openings or slits 56 are activated and which are located on the upper fold roller 51 in the marginal area of a recess 61.

On the area 23 taken up by the contact adhesive (over the parting agent area 22) is provided a recess 68 in the upper fold roller 51, which can optionally be provided on its bottom with a parting agent coating 62 made from polytetrafluoroethylene (PTFE). The fold back flap 18 is engaged by folding faces 69, 70 having suction openings 56, 56*a*. The faces 69, 70, which are located in the vicinity of a roughly triangular recess 61 shown in FIG. 8, are designed in such a way that in the area of the fold-back flap adjacent to the fold line 17 is sucked by the suction opening 56 under a shallower angle. If then the envelope 11 with the fold line 13 as a result of fold roller rotation approaches the fold gap 63, then the suction air at the suction slit 56 is turned off and instead that at the suction gap 56 belonging to the face 70 is turned on. There could also be a simultaneous turn on. This face is at a greater angle to the tangent at the fold roller 51. As the folding of the fold-back flap 18 takes place very rapidly at the high operating speed, it can bend in or curve as a result of the dynamic forces and, assisted by the suction action of the openings 56*a*, can be applied to the face 70. On drawing the envelope from the upper fold roller 51, the fold-back flap is "peeled" starting from the face 69 following the switching off of the vacuum and is optionally actively reduced. Thus, on folding round the fold-back flap 18 there is a harmonic, gentle transfer to the individual folding positions. This permits a high operating speed and great reliability. A rounding between faces 69, 70 or an overall curved surface could further improve this action.

On switching off the vacuum the suction air-carrying openings and ducts are conventionally vented by means of the described valves or rotary slide valves in order to reduce the vacuum. To speed up this process an active instead of a passive venting can be provided, in that compressed air is supplied by the valves bringing about venting. This has admittedly been proposed for ejecting trimmings, but is unusual in connection with fold rollers, because an active ejection of the fold-back flap is inherently undesired. Thus, active venting must be limited to an amount bringing about a rapid detachment.

With the synchronous further rotation of the fold rollers 51, 53 the closing flap 14 is folded round at the fold line 13 and the fold-back flap 18 at the fold line 17 and the complete envelope is drawn into a fold gap 63 between the lower fold roller 53 and a draw-off roller 64. The closing flap 14 and fold-back flap 18 are correspondingly applied to the envelope points visible in FIG. 3 and the contact adhesive area 23 resting on the parting agent area 22 is applied and pressed onto the previously uncoated fold-back flap 18. The pressure bringing about the adhesive transfer from the parting agent coating to the fold-back flap is either applied in the device or only during packing or in the pack.

The double-line bonding of the side flaps by means of the two parallel glue seams 21 for each flap and a particularly rapidly hardening adhesive ensure a particularly reliable gluing operation and also ensure that despite the high conveying speed the glue has already hardened when the envelope reaches the folding station. As a result and due to the three-layer envelope structure in this area (front side, rear side and side flap) together with the interposed glue between the bottom fold 15 and fold line 17, said area is relatively stiff, so that the folding round of the fold-back flap along the fold line 17 can take place without any difficulty. This in particular prevents the folding round of the fold-back flap tearing open the adhesive closure between the side flaps and the back of the envelope. These two parallel glue seams also make it possible to effect a gluing covering a relatively large area without so much glue being applied that it is forced out sideways or towards the fold-back flap.

In the subsequent delivery station 65 by means of a delivery drum 66 (fan wheel), the stream of envelopes is placed on a conveyor 67 and passed onto the packing station.

Corresponding to the nature and design of the envelopes in such a device 30 additional stations can be provided for the individual operations to be carried out or in part stations can be replaced by others or omitted, a different sequence also being possible.

Figure 6:
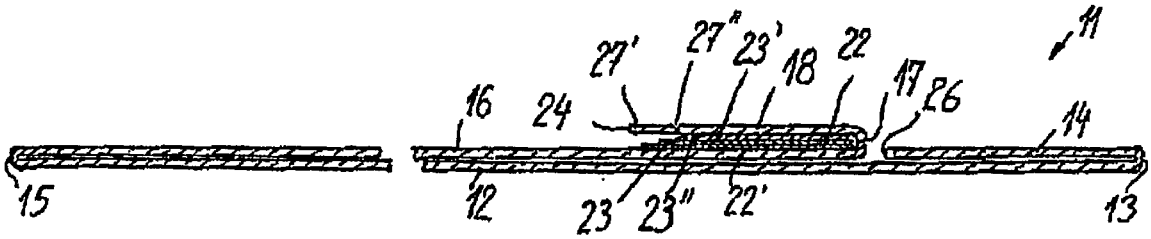
FIG. 6 A greatly enlarged section along line VI to VI in FIG. 3, but with respect to a variant.

FIG. 6 shows a larger scale partial section in which in particular the material thicknesses are greatly exaggerated so as to render them visible. The parting agent coating 22 is applied to a primer coating 22', which permits on the one hand a preparation for the parting agent, e.g. by closing the paper pores and also an adhesive promotion between the paper and parting agent. For this purpose in the device described relative to FIG. 7 there can be a further application unit in a printing station and namely, as a function of the type of primer, with or without a drying or hardening means upstream of the parting agent application.

FIG. 6 also shows that on the fold-back flap 18 can be provided a front gripping area 27' connected to the edge 24 and which is not outside the contact adhesive area 23 and which is separated therefrom by a prebreak line 27" (scoring, line impression, etc.). This strip-like gripping area 27' can be easily put up with the finger and gripped in order to draw up and put up the fold-back flap 18.

Thus, the invention preferably provides an envelope comprising a front side and a rear side, which are interconnected by means of side flaps, which is provided with a fold-back flap to which a contact adhesive coating is applied. It is a strongly acting, adhesive contact adhesive, which is effective without moistening or any other activation. For transportation and storage the fold-back flap is applied to the back of the envelope and a parting agent-coated area is provided in order to permit the re-release of the contact adhesive prior to use. For closing purposes, the otherwise uncoated closing flap is pressed onto the contact adhesive-coated fold-back flap.

The application of the contact adhesive to the fold-back flap takes place by transfer, i.e. the contact adhesive is applied during manufacture to the parting agent coating and is taken over by the latter during the straightening of the fold-back flap.

What is claimed is:

1. An envelope having:

a front side and back side;

a closing flap connected to the front side;

a fold-back flap which can be folded from a stored state into a closed state, which in the stored state is folded against the envelope back side, and which in the closed state is bonded to the closing flap; and an adhesive closure including a contact adhesive coating, wherein in the stored state the contact adhesive coating is applied to a surface area of the envelope having separating characteristics and defining a separating area, wherein the contact adhesive coating, a surface of the contact adhesive area and the separating area are constructed so as to cooperate in such a way that the contact adhesive coating applied to the separating area is firmly bonded with its top onto the surface of the contact adhesive area of the envelope pressed onto the same, wherein the contact adhesive coating becomes separated in the closed state from the separating area, and the previous underside of the contact adhesive coating area now forms the surface of the contact adhesive coating having contact adhesive properties, and wherein on an edge of the envelope adjacent to an outer edge of the fold-back flap the contact adhesive has gripping recesses or a prebreak defining a gripping zone.

2. A method for producing an envelope having an envelope front side, an envelope back side and flaps, each flap being connected to one of said sides by a respective fold line, the method comprising the steps of:

forming one of said flaps as a closing flap connected to the envelope front side;

forming another of said flaps as a fold-back flap, which can be folded from a stored state to closing state, which in the stored state is folded against the envelope back side;

applying a parting agent to a surface area of the envelope to form a separating area;

drying or hardening the parting agent;

applying a permanently sticky contact adhesive to the separating area of the envelope provided with the parting agent;

enclosing the contact adhesive between the separating area and an adhesive transfer area of the envelope by folding one of said flaps at its respective fold line;

pressing the adhesive transfer area against the contact adhesive, whereby the contact adhesive is detached from the separating area provided with the parting agent and transferred to the adhesive transfer area.

3. The method according to claim 2, wherein the folding of at least one of the fold-back flap and the closing flap takes place using controlled suction air assistance and ending of the suction action is accelerated by supplying compressed air.

4. The method according to claim 2, wherein the contact adhesive is applied to a stream of successive envelopes flowing in a conveying direction in areas spaced, in the conveying direction and optionally the stream moves with a limited or no mutual overlapping of the envelopes.

5. A device for producing envelopes each having:

a closing flap connected to an envelope front side, and a fold-back flap which can be folded up from a stored state into a closing state, which in the stored state is folded against an envelope back side;

an adhesive closure including a permanently sticky contact adhesive, which is applied to the envelope, a separating area having separating characteristics with respect to the adhesive closure, the contact adhesive being enclosed between the separating area and an adhesive transfer area of the envelope, the device comprising:

a parting agent application station in the manner of a printing unit for the application of a parting agent to a surface of the envelope thereby forming the separating area and a drying device for drying or hardening the parting agent; and a contact adhesive application station, which is equipped with an applicator for application of adhesive to the envelope.

6. The device according to claim 5, further comprising a folding station for folding the foldback flap and optionally the closing flap, the folding station having a fold roller for the fold-back flap, which in an area of the envelope provided with contact adhesive has at least one of a recess and a parting agent surface.

7. The device according to claim 6, wherein the fold roller has a suction area with suction openings, the suction area located in the vicinity of a recess of the fold roller and whose suction faces form with respect to the outer edge of the fold-back flap a larger angle to a tangent on the fold roller.

8. The device according to claim 6, wherein the folding station is directly connected to an extraction station, where the envelopes are separated and which directly supplies the folding station.

9. The device according to claim 6, further comprising a conveying means conveying the envelopes between a separating cutting station and the folding station in the form of an only slightly staggered or unstaggered stream of successive envelopes.

10. The device according to claim 6, wherein the folding station is connected to the contact adhesive application station without an interposed drying station.

11. The device according to claim 6, wherein the fold roller has an orienting stop for the leading envelope bottom edge in the conveying direction.

12. The device according to claim 5, wherein the application station immediately follows a roll means for a material web from which the envelopes are produced, and a fixing station is optionally associated with the application station for drying or hardening the parting agent, particularly using UV lamps.

13. The device according to claim 5, further comprising a staggering station, which has at least one staggering roller which cooperates with the in each case leading edge of each envelope and that said staggering roller is provided on its circumference with stops or steps.

14. The device according to claim 5, wherein the applicator is an application roller.

15. The device according to claim 14, wherein the application roller has one or more individual, mutually spaced application segments with an optionally rastered surface.

* * * * *